US007179203B2

(12) United States Patent
Pan et al.

(10) Patent No.: US 7,179,203 B2
(45) Date of Patent: Feb. 20, 2007

(54) ELEVATING APPARATUS OF TREADMILL

(75) Inventors: Francis Chung Hwa Pan, Taichung (TW); Pao-Chuan Wang, Taichung County (TW); He-Yu Chen, Taichung County (TW)

(73) Assignee: Forhouse Corporation, Taichung Hsien (TW)

( * ) Notice: Subject to any disclaimer, the term of this patent is extended or adjusted under 35 U.S.C. 154(b) by 0 days.

(21) Appl. No.: 11/100,554

(22) Filed: Apr. 7, 2005

(65) Prior Publication Data

US 2006/0142125 A1 Jun. 29, 2006

(51) Int. Cl.
*A63B 22/00* (2006.01)

(52) U.S. Cl. ..... 482/54

(58) Field of Classification Search ..... 482/51, 482/54

See application file for complete search history.

(56) References Cited

U.S. PATENT DOCUMENTS 5,967,945 A * 10/1999 Wang ..... 482/54
6,475,121 B2 * 11/2002 Wang et al. ..... 482/54
6,699,160 B1 * 3/2004 Pan et al. ..... 482/54
6,811,518 B2 * 11/2004 Lin ..... 482/54
6,884,201 B2 * 4/2005 Wu ..... 482/54

* cited by examiner

*Primary Examiner*—Stephen R. Crow
(74) *Attorney, Agent, or Firm*—Birch, Stewart, Kolasch, and Birch, LLP

(57) ABSTRACT

A treadmill has a frame, a table assembly and an elevating apparatus to elevate the table assembly. The treadmill has a driving device provided at a bottom side of the table assembly. A transverse shaft is connected to the driving device. Two first linkages each has three pivot portions, wherein two of the pivot portions at ends thereof are pivoted on the table assembly and ends of the transverse shaft respectively. Two second linkages have opposite ends pivoted on the frame and the table assembly respectively, each of which has a pivot portion between the ends thereof to be pivoted on the first linkages at the third pivot portions respectively.

8 Claims, 6 Drawing Sheets

ELEVATING APPARATUS OF TREADMILL

BACKGROUND OF THE INVENTION

1. Field of the Invention

The present invention relates generally to a gymnastic machine, and more particularly to a treadmill with an elevating apparatus.

2. Description of the Related Art

Typically, a treadmill is classified into two types, namely fixed table and adjustable table. The fixed table treadmill has a table with a constant slope and the adjustable table treadmill can adjust the slope of the table. The adjustable table treadmill usually is provided with a control apparatus to be manipulative to change the slope of the table. There are many designs for the control apparatus, most of them have a linkage connecting a driving device and the table for the elevating function. The angle of the table to be changed is limited by the length of the linkage and the position of the fulcrum, such that the conventional treadmill only has a smaller range of adjustable slope.

SUMMARY OF THE INVENTION

The primary objective of the present invention is to provide a treadmill, which the table thereof has a greater range of adjustable slope.

According to the objective of the present invention, an elevating apparatus of a treadmill comprises a driving device provided at a bottom side of a table assembly of the treadmill to provide a reciprocating driving power. A transverse shaft is connected to the driving device. Two first linkages each having three pivot portions are provided. Two of the extreme pivot portions are pivoted on the table assembly with the other pivot portion being on an end of the shaft. Two second linkages have opposite ends pivoted on the frame and the table assembly respectively. A mid portion of each of the second linkages being pivoted on the first linkages at the third pivot portions.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE INVENTION

Figure 1:
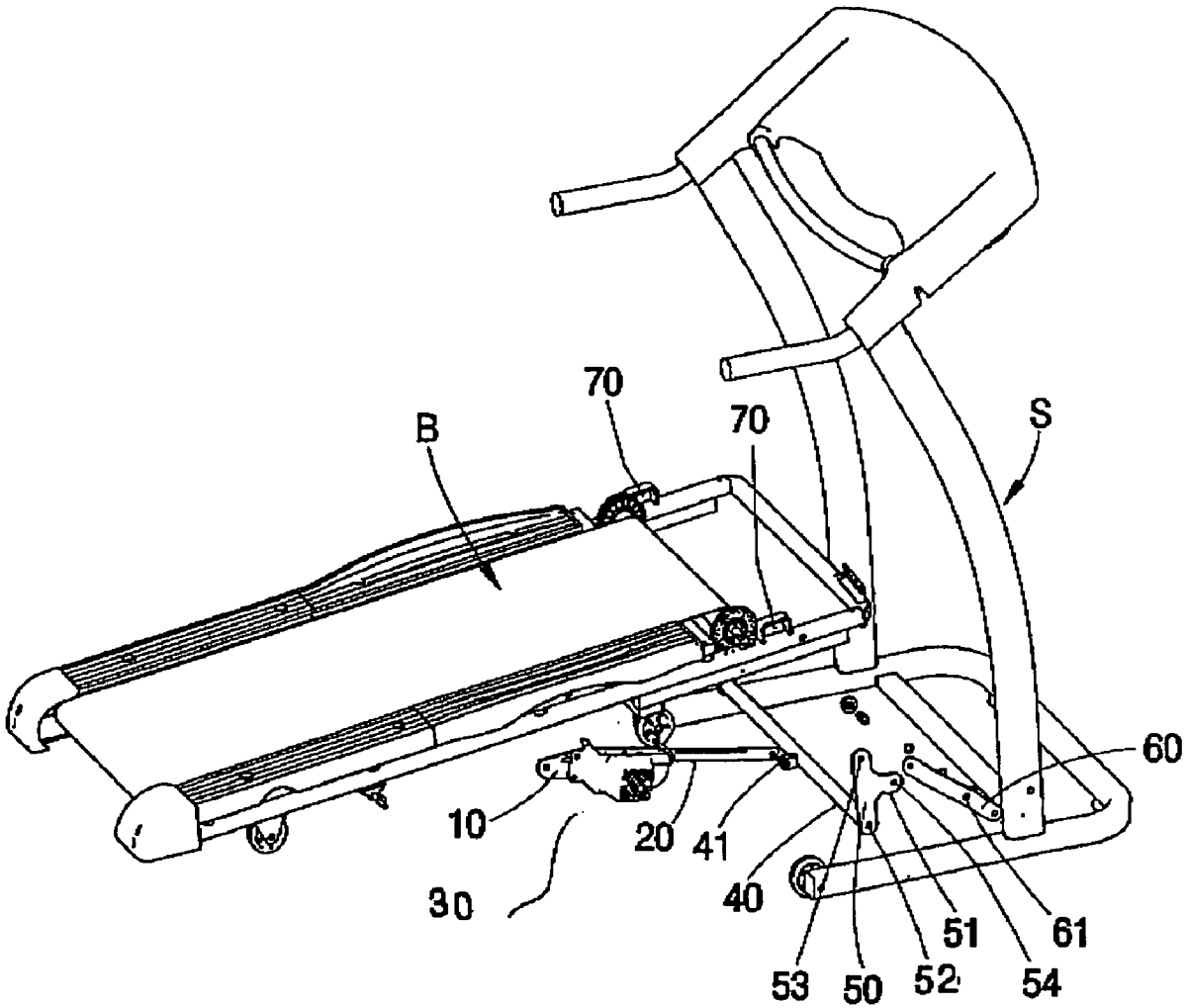
FIG. 1 is an exploded view from the left of a preferred embodiment of the present invention.
Figure 2:
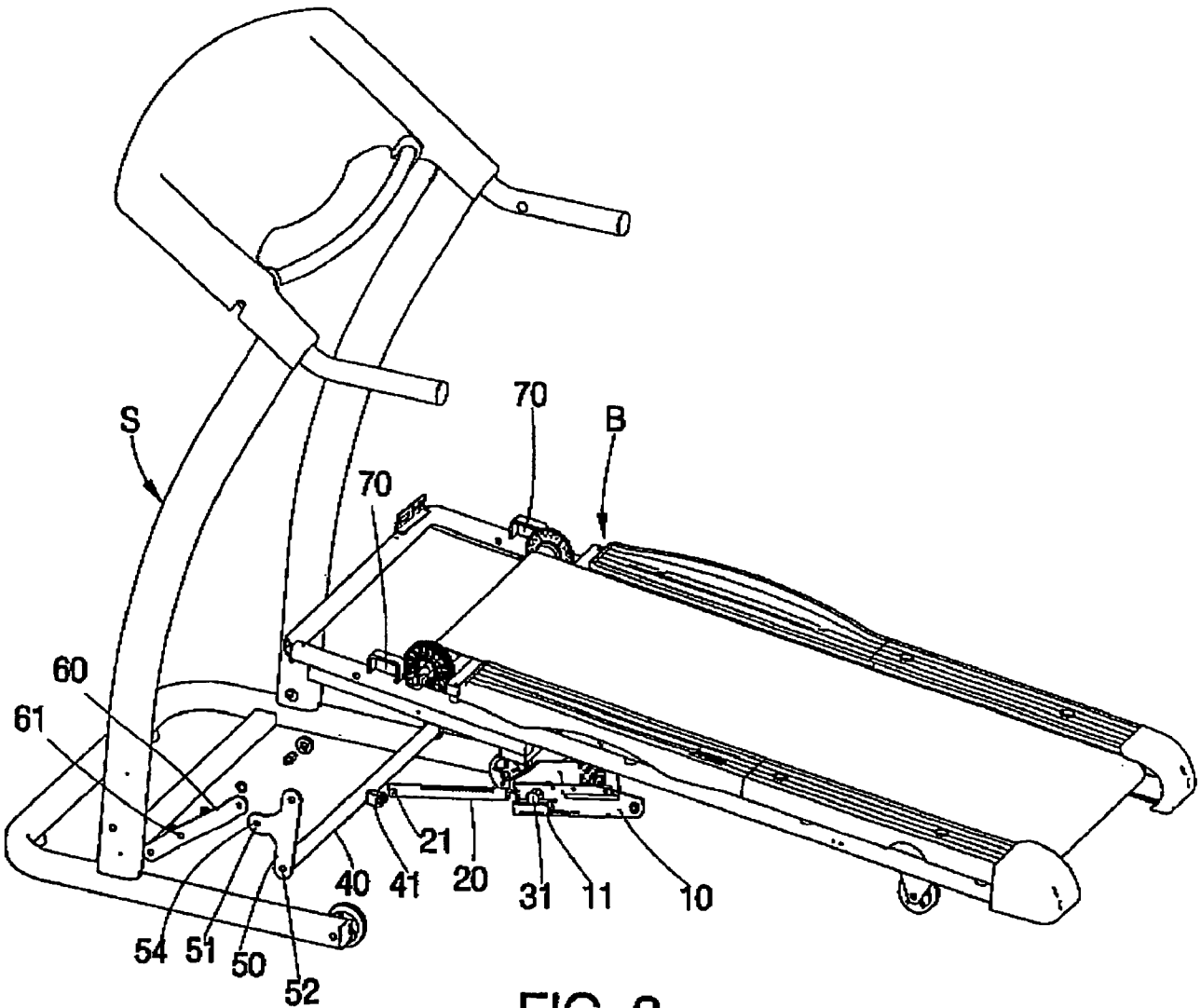
FIG. 2 is an exploded view from the right of the preferred embodiment of the present invention.
Figure 3:
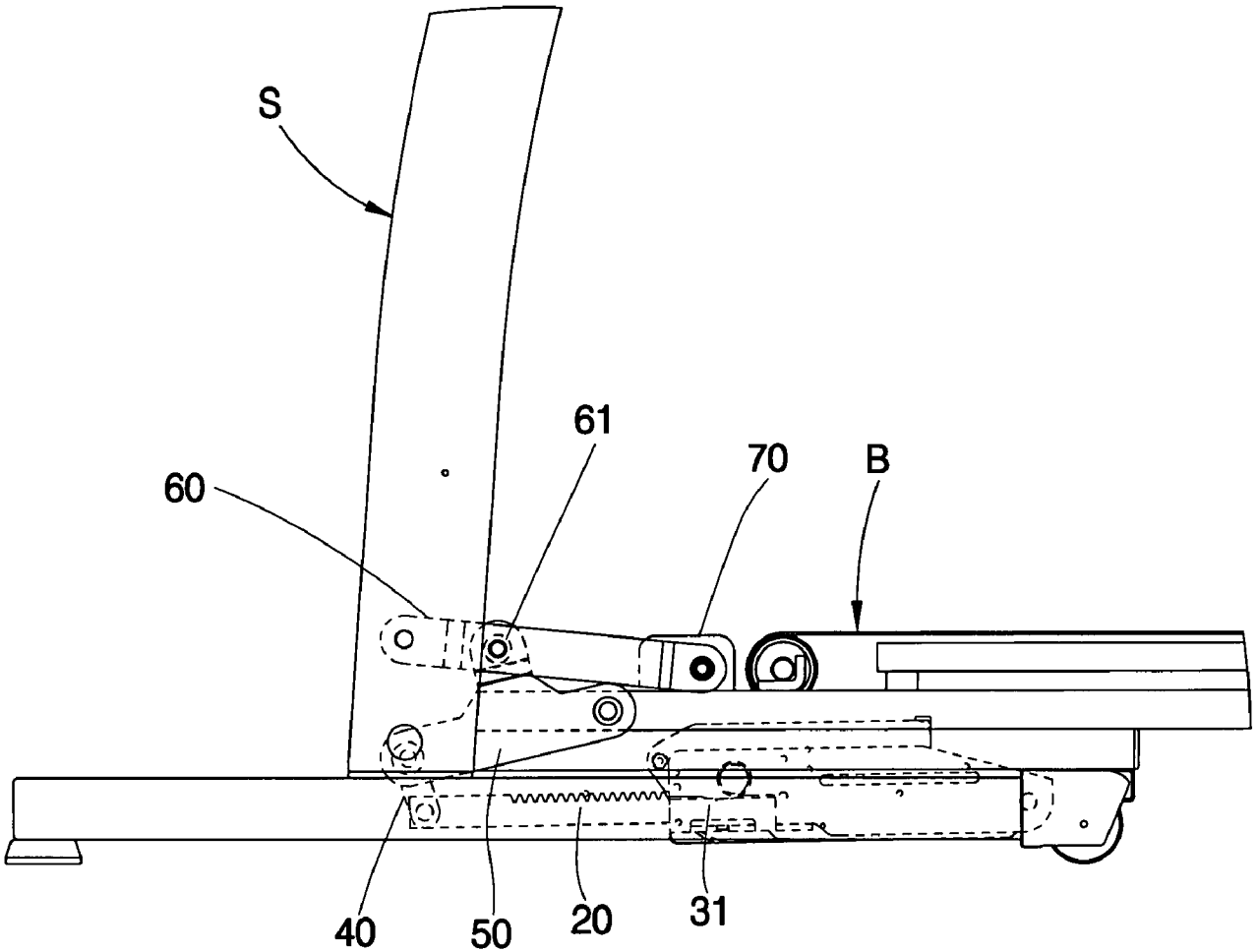
FIG. 3 is a perspective view of the preferred embodiment of the present invention, showing the table at the lowest position.

As shown in FIG. 1 to FIG. 3, a treadmill of the preferred embodiment of the present invention has a frame S, a table assembly B and an elevating apparatus between the frame S and the table assembly B.

A driving device provides power to elevate the table assembly. This driving device can be a rack driving device or a worm driving device. In the present invention, it is a rack driving device. The rack driving device includes a base frame 10 pivoted on a bottom of the table B. The frame 10 has a slot 11 parallel to a longitudinal axis of the table B.

A transmission device 20 is received in the slot 11 of the base frame 10. The transmission device 20 can be reciprocated along the slot 11. The transmission device 20 has a pivot portion 21 at an end thereof opposite the end at the slot 11. In the present invention, the transmission device 20 is a rack received in the slot 11 of the base frame 10.

A motor 30 is mounted on the base frame 10 to move the transmission device 20. The motor 30 is provided with a gear 31 to be meshed with the transmission device 20 and to reciprocate it.

The elevating apparatus of the present invention further includes a transverse shaft 40 with a pivot portion 41. Portion 41 is pivotally attached on the pivot portion 21 of the transmission device 20.

Two first linkages 50 each have a convex portion 51 at a middle section thereof and three pivot portions 52, 53 and 54. Locations of the pivot portions 52, 53 and 54 form a triangle, wherein the first and second pivot portions 52 and 53 are located at opposite ends of the first linkages 50, and the third pivot portion 54 is located at the convex portion 51. The first linkages 50 are fixed on the table assembly B and the transverse shaft 40 with the first and second pivot portions 52 and 53. In the present invention, the first linkages are T-shaped elements, and the pivot portions 52, 53 and 54 are holes at three ends respectively.

Two second linkages 60 have opposite ends pivoted on the frame S and table assembly B, respectively. The second linkages 60 each have a pivot portion 61 at a middle section thereof to be pivoted on the first linkages 50 at the third pivot portions 54 respectively. In the present invention, the table assembly B has two slots 70 at opposite sides respectively to be pivoted with the second linkages 60 respectively.

As shown in FIG. 3, the motor 30 moves the transmission device 20 outwardly, and the transmission device 20 moves the second pivot portions 53 of the first linkages 50 distal to the base frame 10. In the meantime, the first pivot portions 52 of the first linkages 50 are moved downwardly, and the second linkages 60 are moved to ends of the slots 70 proximal to the base frame 10. As a result, the table assembly B is moved downwardly to a lowest position.

Figure 4:
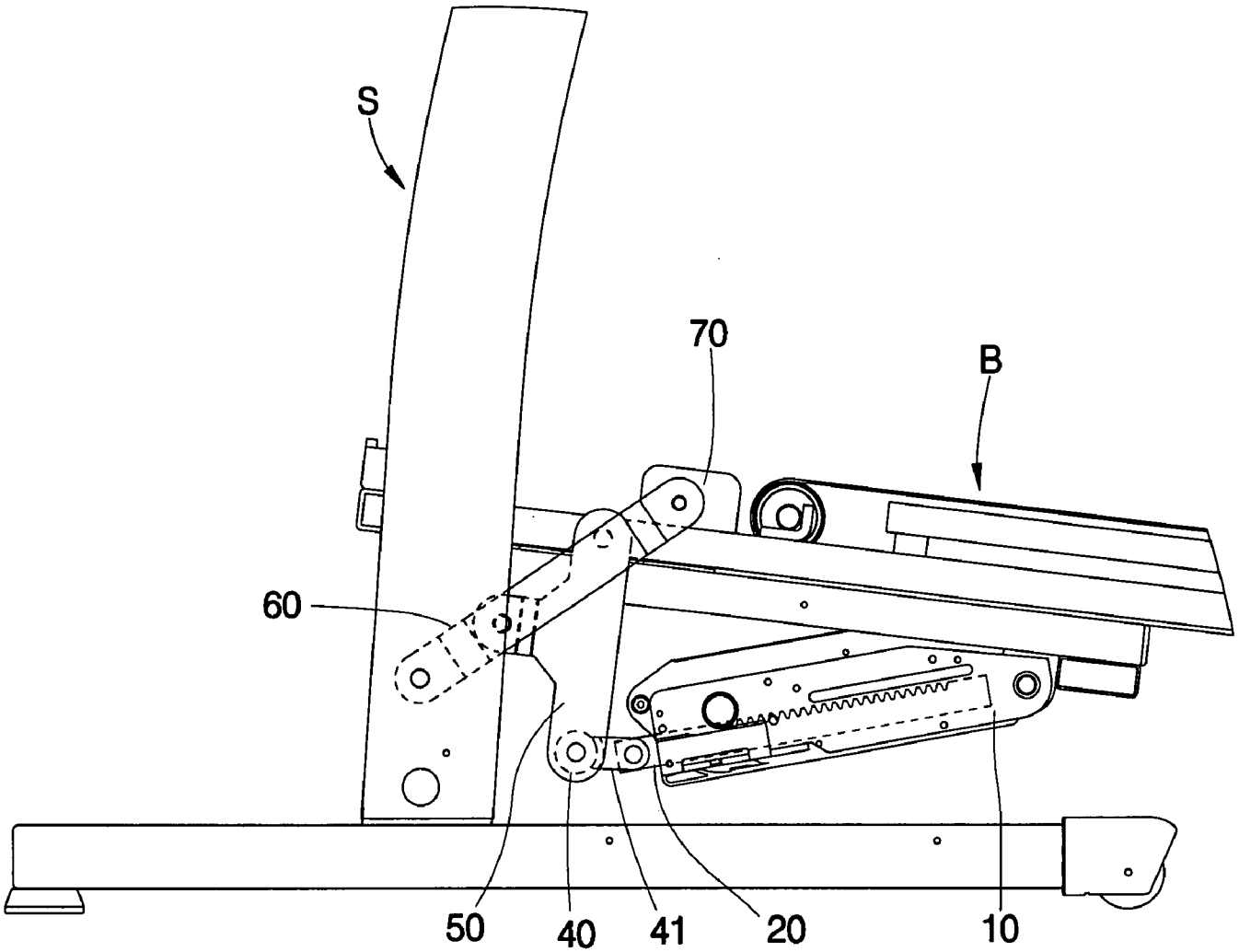
FIG. 4 is a perspective view of the preferred embodiment of the present invention, showing the table at the highest position.

To elevate the table assembly B, as shown in FIG. 4, the motor 30 draws the transmission device 20 inwardly, and the transmission device 20 moves the second pivot portions 53 of the first linkages 50 proximal to the base frame 10 that moves the first pivot portions 52 of the first linkages 50 upwardly with the third pivot portions 54 to be the fulcrums. As a result, the table assembly B is elevated to a highest position.

Figure 5:
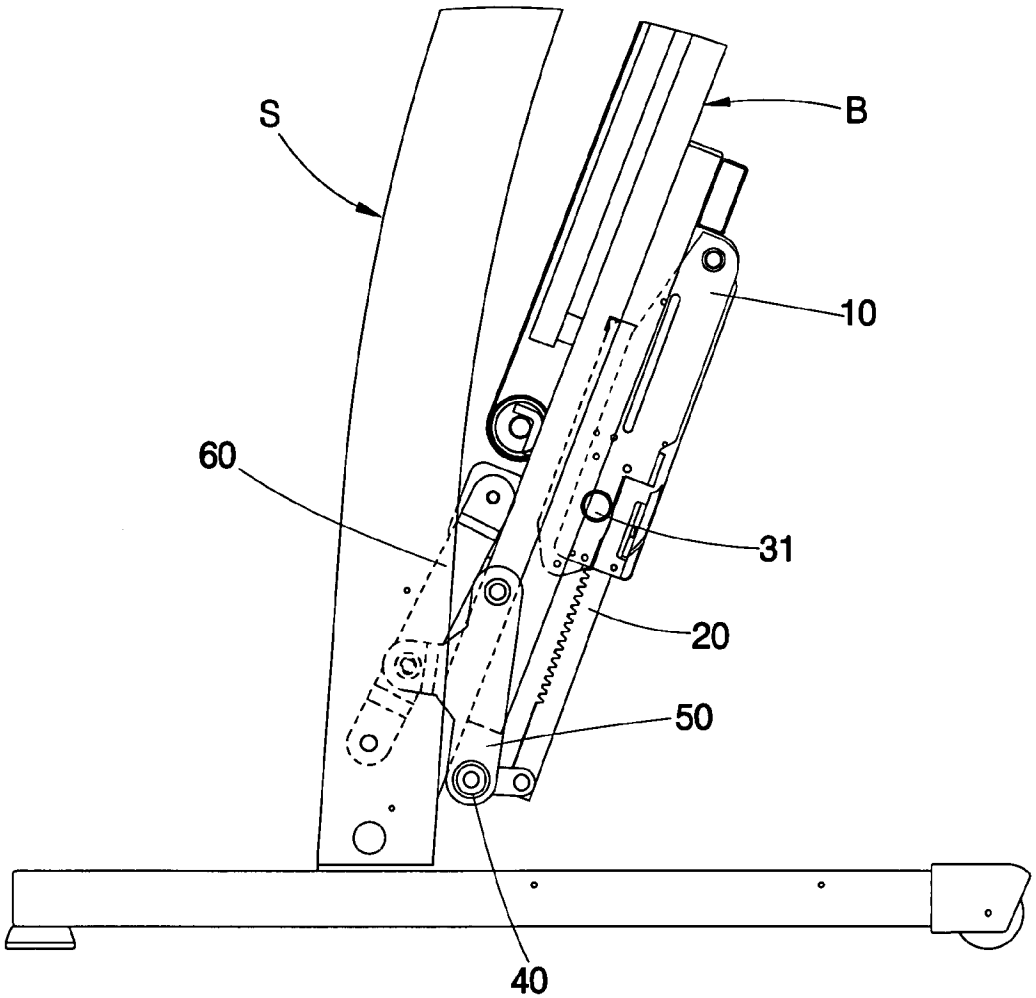
FIG. 5 is a perspective view of the preferred embodiment of the present invention, showing the table at the lowest position and folded.
Figure 6:
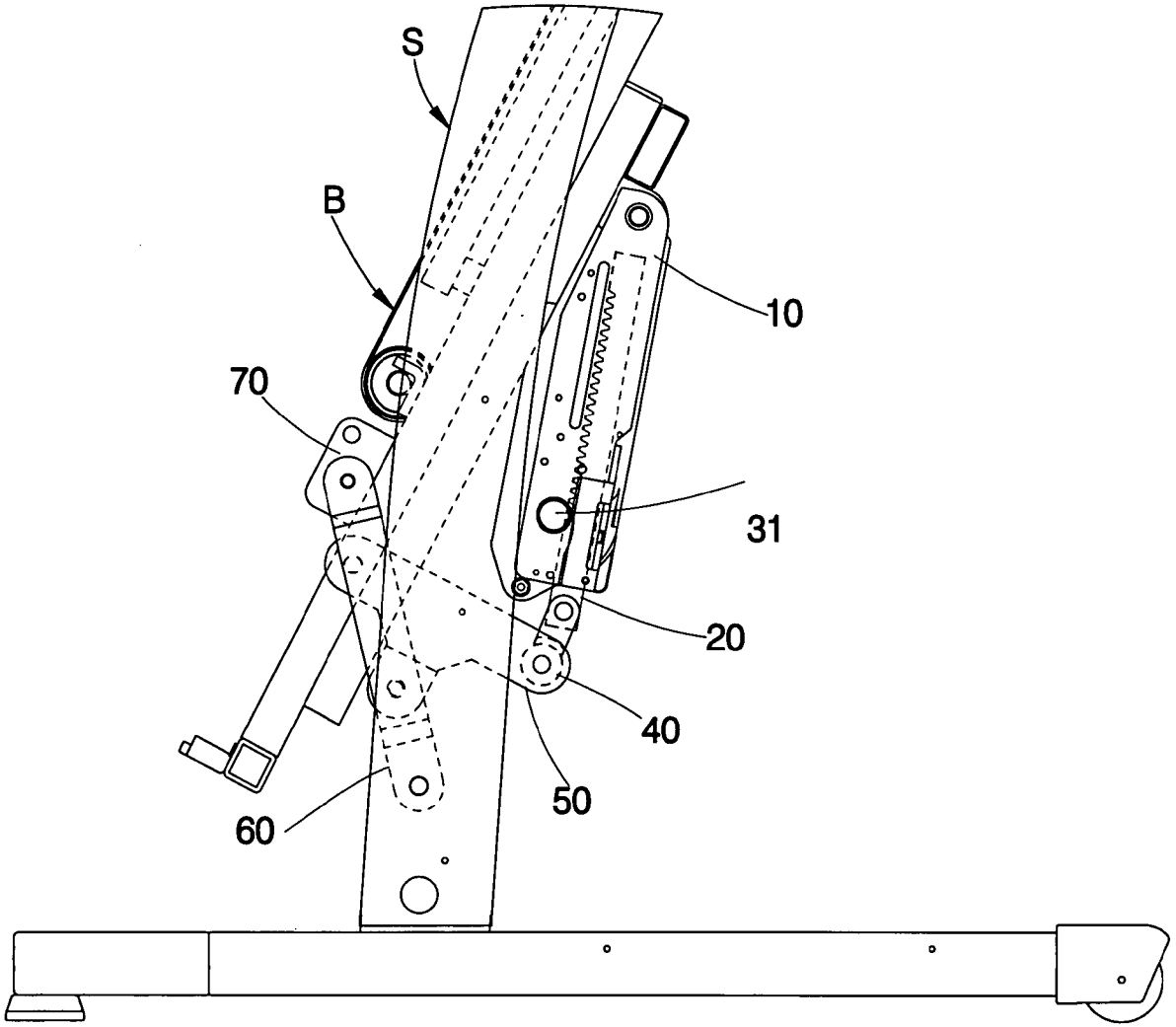
FIG. 6 is a perspective view of the preferred embodiment of the present invention, slowing the table at the highest position and folded.

The main function of the second linkages 60, which link the table assembly B and the frame S, is to fold the table assembly B in both condition of the table assembly B at the highest position and at the lowest position, as shown in FIG. 5 and FIG. 6.

The height of elevation of the elevating apparatus of the present invention is not only associated with the length of the first linkages 50 but also the slope of the second linkages 60. Please compared FIG. 3 with FIG. 4, the movement of the transmission device 20 changes the slopes of the first linkages 50, and the slopes of the second linkages 60 are increased as well that elevate the first linkages 50 for a predetermined distance because the third pivot portions 54 of the first linkages 50 are pivoted on the second linkages 60. As a result, the distance between the lowest position and the highest position of the table assembly B is a vertical distance of the slope change of the first linkages 50 plus the distance of the second linkages 60 elevating the first linkages 50.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An elevating apparatus for a treadmill connecting a frame and a table assembly of the treadmill, the elevating apparatus comprising:

a driving device on a bottom side of the table assembly, the driving device including a motor;

a transverse shaft operatively connected to the motor, the transverse shaft being pivotable by the motor, the transverse shaft having two opposed ends;

a first linkage on each end of the transverse shaft, the linkage having a first pivot portion, a second pivot portion and a third pivot portion, the first pivot portions of each linkage being attached to the table assembly of the treadmill, the second pivot portions of each of the linkage being attached to the transverse shaft; and a pair of second linkages, each of the second linkages extend from the table assembly to the frame of the treadmill and each second linkage has a pivot portion, the pivot portions of a first one of the second linkages being pivotally connected to the third pivot portion of one of the first linkages, the pivot portions of a second one of the second linkages being pivotally connected to the third pivot portion of another one of the first linkages.

2. The elevating apparatus as defined in claim 1, wherein the first pivot portion, the second pivot portion and the third pivot portion of each of the first linkages forms a triangle.

3. The elevating apparatus as defined in claim 2, wherein at least one of the first linkage has a convex portion at a middle section thereof, the third pivot portion being located on the convex portion.

4. The elevating apparatus as defined in claim 1, wherein the second linkages are engaged in one of two slots provided on the table assembly.

5. The elevating apparatus as defined in claim 1, wherein the driving device includes a rack driving device.

6. The elevating apparatus as defined in claim 1, wherein the driving device is a worm driving device.

7. The elevating apparatus as defined in claim 1, the driving device includes a transmission device connected between the motor and the transverse shaft, the motor draws the transmission device inwardly to reduce a length of the transmission device between the motor and the transverse shaft, the motor moving the transmission device inwardly thereby pivots the transverse shaft to rotate the first linkages and the second linkages to elevate the table assembly.

8. The elevating apparatus as defined in claim 7, wherein the motor moves the transmission device in a first direction when drawing the transmission device inwardly and wherein the motor moves the transmission device in a second direction when lowering the table assembly, the second direction being opposite the first direction.

* * * * *